United States Patent [19]

Parsons et al.

[11] 4,428,556

[45] Jan. 31, 1984

[54] UNIVERSAL CONCRETE SCREED SYSTEM

[75] Inventors: Albert Parsons; H. Norris Havens, both of Columbia, S.C.

[73] Assignee: Consolidated Systems, Inc., Columbia, S.C.

[21] Appl. No.: 376,608

[22] Filed: May 10, 1982

[51] Int. Cl.[3] ..... B29C 7/00

[52] U.S. Cl. ..... 249/3; 249/9; 249/210

[58] Field of Search ..... 249/3, 9, 35, 4, 5, 249/6, 7, 210

[56] References Cited

U.S. PATENT DOCUMENTS

| | | | |
|---|---|---|---|
| 1,474,659 | 11/1923 | White | 249/210 |
| 3,057,269 | 10/1962 | Artigalas | 249/3 |
| 3,497,172 | 2/1970 | Welch | 249/3 |
| 3,561,721 | 2/1971 | Self | 249/9 |
| 3,770,237 | 11/1973 | Burton | 249/3 |
| 4,012,024 | 3/1977 | Courtois | 249/3 |

*Primary Examiner*—Donald E. Czaja
*Assistant Examiner*—Mary A. Becker
*Attorney, Agent, or Firm*—L. Lawton Rogers, III

[57] ABSTRACT

A system of forms for facilitating the pouring of concrete into slabs including a single "universal" screed stake with three vertically spaced pairs of fingers or ear-like members may be selectively used with screeds of four different vertical dimensions, each of the pairs of earlike members receiving the lower side of one of the screeds with the top of the stakes being received in a downwardly opening pocket formed on the topside of the screed. The horizontally extending channel in the screed is provided with a plurality of spaced slots, so that the top of the stake may be inserted through the slot instead of into the pocket on the topside of the screed when a screed of the fourth vertical dimension is used and the lower end thereof is received into one of the three pairs of ear-like members.

3 Claims, 9 Drawing Figures

UNIVERSAL CONCRETE SCREED SYSTEM

BACKGROUND OF THE INVENTION

This invention relates to a system for forming the joints of concrete slabs used in the construction of roadways, floors and the like.

The basic system of forms including screed and screed stakes is well known and is illustrated, for example, in the Self U.S. Pat. No. 3,561,721 dated Feb. 9, 1981, the Tone U.S. Pat. No. 3,401,612 dated Sept. 17, 1968, the Welch U.S. Pat. No. 3,497,172 dated Feb. 24, 1970 and the Artigalas et al U.S. Pat. No. 3,057,269 dated Oct. 9, 1962. The screed stakes are generally made of metal, approximately 0.07 inches in thickness, approximately 1.00 to 1.25 inches in width and from 12 to 24 inches in length depending on the type of soil in which they are to be driven. Such stakes generally are provided with a central channel for reinforcing purposes with the channel terminating just short of the upper end of the stakes so that the upper end is substantially planar and may be received in a downwardly opening pocket formed on the topside of the screed. Such stakes may also be provided with one or more "fingers" or ear-like members formed out of the stake material to extend upwardly alongside the stake to form an upwardly opening pocket into which the lower side of the screed may be inserted.

The vertical depth of the concrete slabs being poured, and thus the vertical width of the screed necessary to form the key joint in the slab, differs substantially with the four typical dimensions being 3.5, 4.5, 5.5 and 7.5 inches. With known systems, it has been necessary to maintain an inventory of stakes with these ear-like members at different dimensions from the top end of the stake, so that a screed of the desired vertical dimension may be held securely in place. The maintenance of this inventory of stakes is costly not only in the initial cost of procuring the stakes, but in the time and effort necessitated in maintaining their separation, as well as the space needed in the transportation to and storage thereof at the site. There is thus a need for a "universal" stake which may be used with screeds of differing vertical dimensions.

Known attempts to provide a "universal" stake have included the location of a single ear-like member located one on each side of the central reinforcing channel in the stake at two different vertical heights. Such stakes have the disadvantage in that they provide only a single ear-like member for the screed thereby increasing the likelihood of an undesirable rotation between screed and stake and require two different stakes for the four standard slab depths.

It is accordingly an object of the present invention to obviate the deficiencies of the known systems and to provide a system having a single "universal" stake usable with each of the four standard screed depths.

It is a further object of the present invention to provide a system having a single "universal" stake usable both at the ends and intermediate the length of the screed.

The advantages of the present invention are achieved through the use of a stake provided with three vertically spaced pairs of ear-like members located one each on opposite lateral sides of the reinforcing channel in the stake, and by the use of a screed of the fourth vertical width having a plurality of spaced slots located adjacent the top of the key through which the top of the stakes may pass when the fourth screed is used with one of the three sets of fingers.

The advantages of the present system will be readily apparent to one skilled in the art from the claims and from the following detailed description when read in conjunction with the appended drawings.

THE DRAWINGS

DETAILED DESCRIPTION

Figure 1:
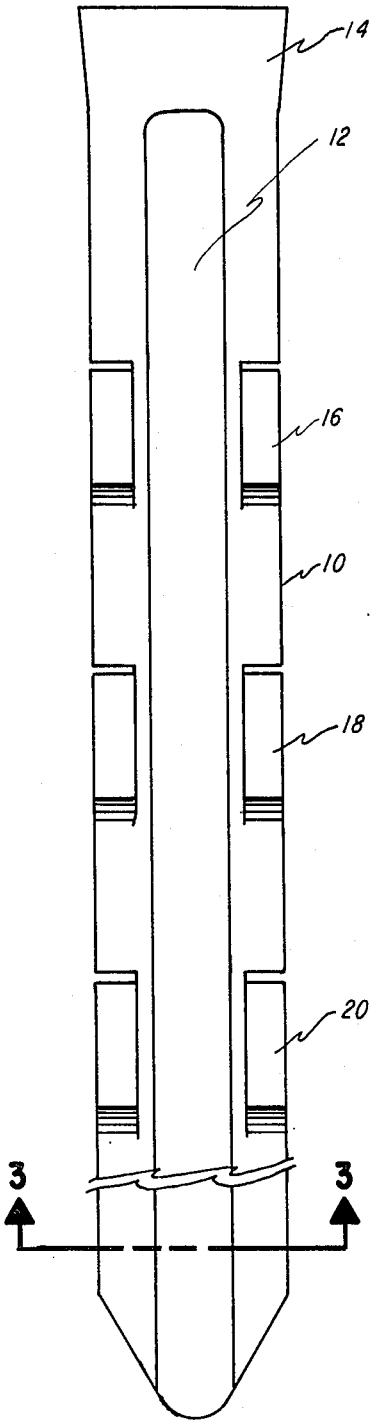
FIG. 1 is a front view in elevation of the screed stake of the present invention.
Figure 2:
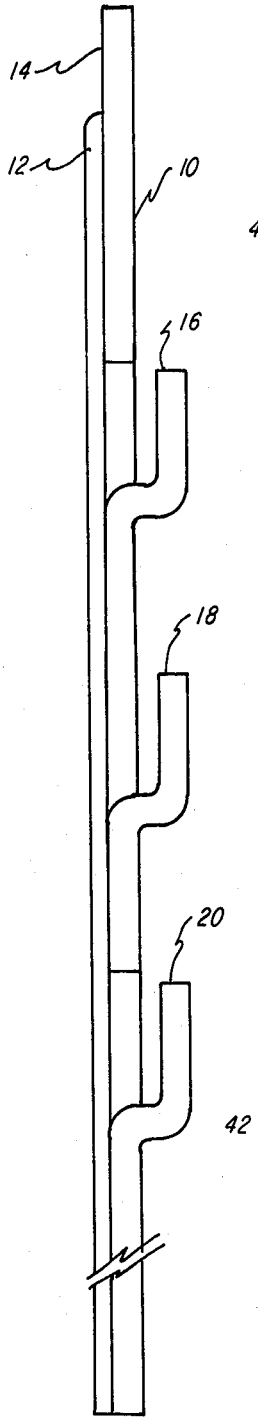
FIG. 2 is a side view of the stake of FIG. 1.

With reference to FIGS. 1 and 2, the preferred embodiment of the stake 10 is made of steel of approximately 0.07 inches in thickness and is formed with a central reinforcing channel 12 approximately 0.5 inches wide and 0.25 inches deep. The finished width of the stake is approximately 1.25 inches, but slightly larger at the upper end 14 thereof where the channel does not extend. The length of the stake may be varied as a function of the anticipated soil conditions into which the stake is to be driven, i.e., typical lengths are 12 inches, 15 inches, 18 inches and 24 inches.

With continued reference to FIGS. 1 and 2 where like numerical indications have been applied to like elements, the stake is provided with three vertically spaced pairs of "fingers" or ear-like members with one pair of ear-like members 16 located with the bottom of the pocket formed thereby approximately 3.5 inches from the top of the stake, with the second pair of ear-like members 18 located with the bottom of the pocket formed thereby approximately 5.5 inches from the top of the stake, and with a third pair of ear-like members 20 formed with the bottom of the pocket formed thereby approximately 7.5 inches from the top of the stake.

Figure 4:
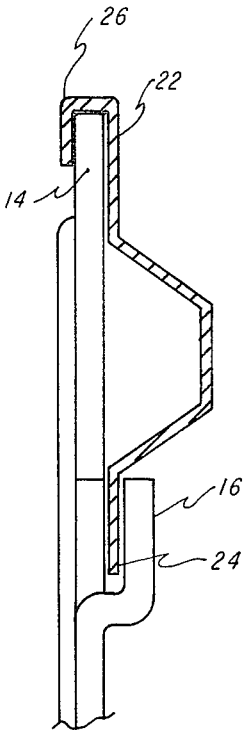
FIG. 4 is an elevation in partial section showing the use of a screed having a first vertical width with the stake of FIG. 1.

As shown in FIG. 4, the stake of FIGS. 1 and 2 may be used with a screed 22 of approximately 3.5 inches depth by inserting the lower edge 24 of the screed into the pocket formed by the ear-like member 16 and receiving the upper portion 14 of the stake into the downwardly opening pocket formed at the upper edge 26 of the screed.

Figure 5:
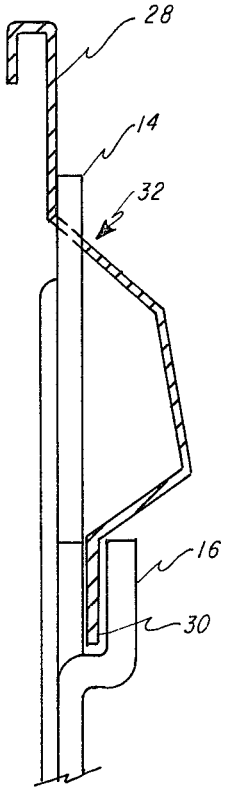
FIG. 5 is an elevation in partial section showing the use of a screed having a second vertical width in connection with the stake of FIG. 1.
Figure 9:
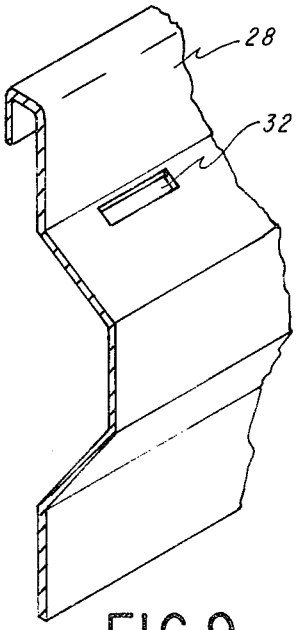
FIG. 9 is an elevation in partial section of the screed illustrated in FIG. 5.

As shown in FIG. 5, the stake of FIGS. 1 and 2 may also be used with a screed of 4.5 inches in vertical depth by the insertion of the lower end 30 thereof into the pocket formed by the ear-like member 16 and by inserting the upper end 14 of the stake through a slot 32 in the screed. As shown more clearly in FIG. 9, the screed 28 is provided with a plurality of horizontally spaced slots 32 adjacent the junction of the key-way or channel formed under the central portion of the screed. As shown in FIG. 5, the position of the screed is deformed to some slight extent. However, the upper end of the screed is displaced by only the thickness of the screed stake, approximately 0.07 inches and is considered negligible.

Figure 6:
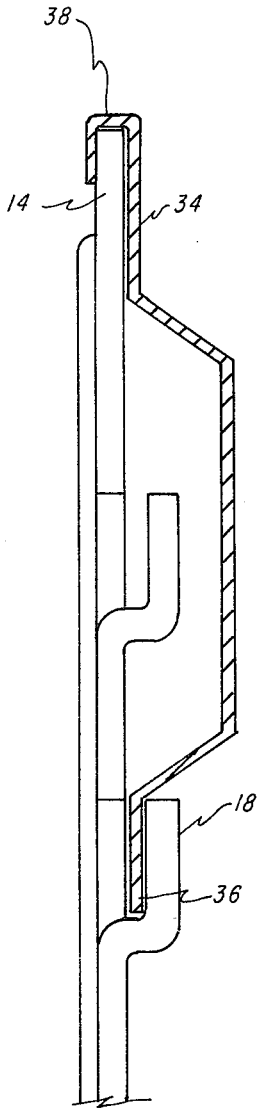
FIG. 6 is an elevation in partial section showing the use of a screed having a third vertical width with the stake of FIG. 1.

As shown in FIG. 6, a screed 34 having a vertical depth of 5.5 inches may be utilized with the stake of FIG. 1 by inserting the lower edge 36 thereof into the upwardly opening pocket formed by the ear-like members 18 and by receiving the upper end 14 of the stake within the downwardly opening pocket formed in the upper side 38 of the screed.

Similarly, a screed 40 of 7.5 inches in vertical depth may be utilized with the stake of FIGS. 1 and 2 by the insertion of the lower edge 42 thereof into the upwardly opening pocket formed by the ear-like members 20 and by receiving the upper end 14 of the stake into the downwardly opening pocket formed in the upper edge 44 of the screed.

Figure 8:
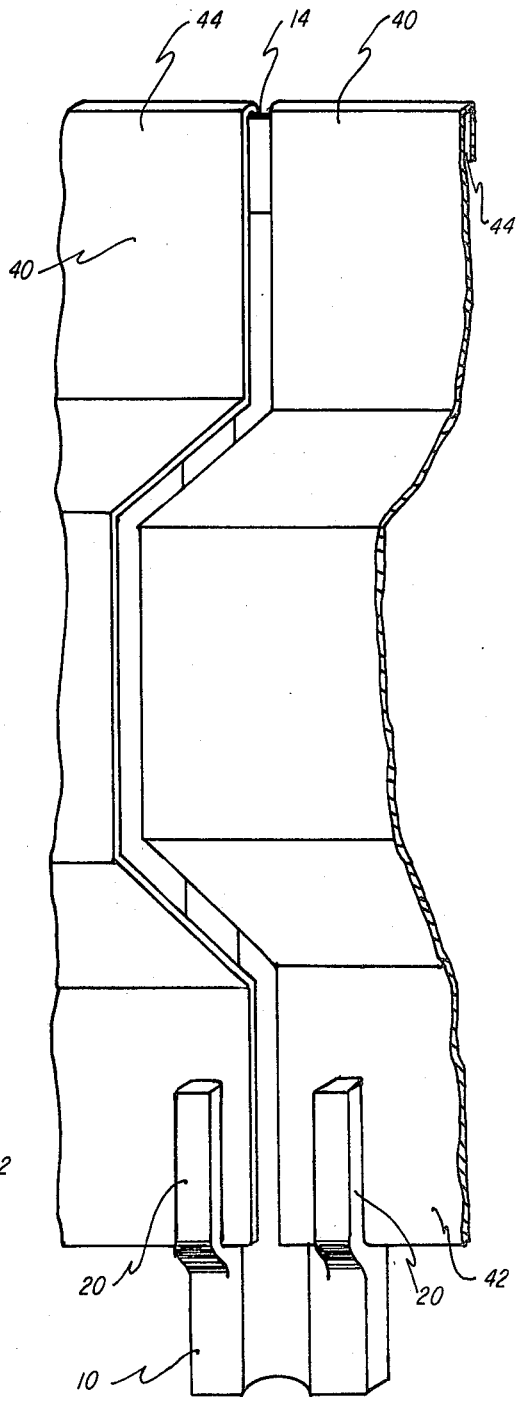
FIG. 8 is a pictorial view in partial section of the screed and stake of FIG. 7 used as an end joint.
Figure 7:
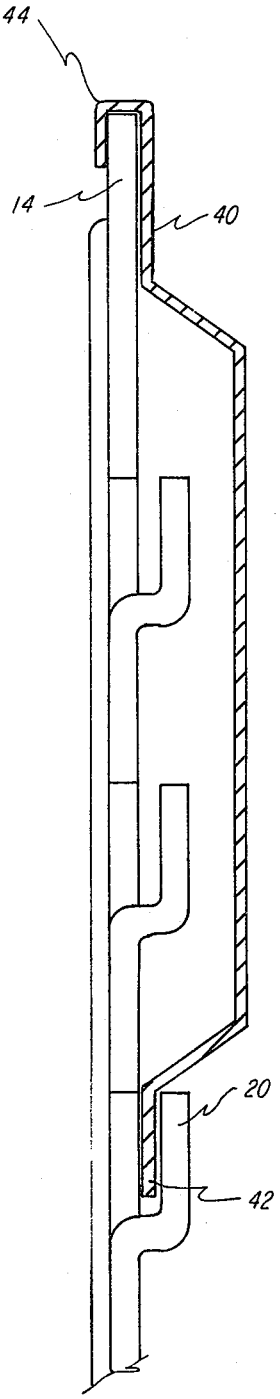
FIG. 7 is an elevation in partial section showing the use of a screed having a fourth vertical width the stake of FIG. 1.

In addition to the use of the stakes of FIGS. 1 and 2 at locations intermediate the length of the screed, the pairs of ear-like members may be used at the joints of the screed as illustrated in FIG. 8. With reference to FIG. 8 where the stake of FIGS. 1 and 2 is illustrated in use with two sections of the screed 40 of FIG. 7, the lower edge 42 of the screed is received in one of the ear-like members 20 and the upper end 14 of the stake received in the downwardly opening pockets formed in the upper edge 44 of the two screed sections. In this way, the same stake may be used not only for four different depths of screed, but may also be used both intermediate the length of the screed and at the screed joints.

ADVANTAGES AND SCOPE THE INVENTION

Figure 3:
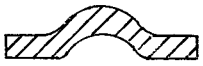
FIG. 3 is a section taken through lines 3—3 of FIG. 1.

As is readily apparent from the claims and from the foregoing description, the system of the present invention obviates many of the inventory, transportation and storage problems of known systems with a significant reduction in cost. The stake illustrated in FIGS. 1–3 may be utilized with screed of four different vertical dimensions, and may be utilized both intermediate the length of the screed and at the ends thereof where joints are required.

The use of the double ear-like members provides increased gripping and rotational stability to the screed as does the slot in the screed where the top of the stake is inserted therethrough.

These and many other advantages will be apparent from the claims and it is to be understood that the forgoing is a description of a preferred embodiment, that many modifications will occur to those skilled in the art, and that the invention is to be limited to the language of the following claims when accorded a full range of equivalents.

What is claimed is:

1. A screed stake for selectively supporting one of four elongated screeds, each differing in their vertical dimension, for forming a joint between immediately adjacent concrete slabs comprising:

a vertically extending stake generally pointed on the lower end and having a reinforcing channel along the longitudinal axis thereof from the lower end thereof to a point adjacent but short of the upper end thereof to leave a generally planar upper end, said stake having three sets of two ear-like members at each of three different distances from the upper end thereof, each of said ear-like members extending laterally from and then upwardly alongside said stake and being adapted to receive the lower end of one of said four screeds of different vertical dimensions, one of each of said set of ear-like members being located on opposite lateral sides of said reinforcing channel and both of each of said set of ear-like members extending upwardly alongside said stake on the same side thereof as said reinforcing channel whereby all four of said vertical dimensions of screed may be supported by said three sets of members in a vertical space insufficient to reasonably accommodate four sets of members, three of said four vertical dimensions of screed being supported by said upper end and said three sets of members respectively, and the fourth of said four vertical dimensions of screed being supported by the uppermost one of said sets of members and by contact with the stake between said upper end and said reinforcing channel.

2. A screed for use with a generally flat screed stake, the stakes having a pair of laterally spaced ear-like members extending laterally from and then vertically upwardly alongside the stake at different distances from the upper end to receive the lower end of a screed and having a generally planar upper end adapted to be received within a downwardly opening pocket formed at the upper end of a screed, said screed comprising:

a horizontally elongated sheet having a horizontally extending channel formed therein in the vertically central portion thereof, the upper side of said elongated sheet forming a downwardly opening pocket on the side of said channel, said pocket being adapted to receive the generally planar end of a screed stake, the lower side of said elongated sheet being adapted for insertion in a pair of ear-like members formed at the same vertical height on one side of a screed stake, the channel of said elongated sheet being provided adjacent the junction of the channel with the upper flat portion of the screed with a longitudinally extending slot dimensioned to accommodate the insertion therethrough of a screed stake, whereby the lower side of said screed may be received in the pair of ear-like members of the stake with either (a) the downwardly opening pocket formed at the upper edge receiving the upper end of the stake or (b) the stake extending upwardly through said slot to a height above the upper end of the stake, whereby screeds of two different vertical dimensions may be used with thhe same pair of ear-like members on a stake.

3. A system for facilitating the pouring of concrete slabs comprising:

a screed having an elongated sheet having a horizontally extending channel formed in a vertically central portion thereof, the upper side of said elongated sheet forming a downwardly opening pocket adapted to receive the generally planar upper end of a screed stake, the lower side of said elongated sheet being adapted for insertion in a pair of ear-like members formed on one side of a screed stake, the channel of said elongated sheet being provided with a plurality of longitudinally spaced, longitudinally extending slots of sufficient dimensions to accommodate the insertion of a stake therethrough; and a plurality of screed stakes each having three vertically spaced pairs of ear-like members extending therefrom upwardly alongside the stake, said ear-like members being adapted to receive the lower edge of said screed, the top of each of said stakes being adapted to alternatively be received in the downwardly opening pocket of said screed or inserted through one of said plurality of slots, whereby a plurality of said stakes may be driven into the ground and the lower side of said screed positioned in a selected one of said pair of ear-like members of said stakes with either (a) the downwardly opening pocket formed in the upper edge of the screed positioned over the upper end of said stake or (b) with the top of said stake extending upwardly through one of said plurality of slots in said screed, the selection being as a function of the vertical dimension of the screed so that screeds of two different vertical dimensions may be used with the same pair of ear-like members on said stake.

* * * * *